US009017068B2

(12) United States Patent
Maekawa et al.

(10) Patent No.: US 9,017,068 B2
(45) Date of Patent: Apr. 28, 2015

(54) TOP-FIRING HOT BLAST STOVE

(75) Inventors: Norimasa Maekawa, Fukuoka (JP); Koya Inoue, Fukuoka (JP); Hiroshi Shimazu, Fukuoka (JP); Shunji Koya, Fukuoka (JP); Naoki Kunishige, Fukuoka (JP); Nobuhiro Ohshita, Fukuoka (JP)

(73) Assignees: Nippon Steel & Sumikin Engineering Co., Ltd., Tokyo (JP); NS Plant Designing Corporation, Fukuoka (JP)

( * ) Notice: Subject to any disclaimer, the term of this patent is extended or adjusted under 35 U.S.C. 154(b) by 0 days.

(21) Appl. No.: 14/005,616

(22) PCT Filed: Mar. 19, 2012

(86) PCT No.: PCT/JP2012/057051

§ 371 (c)(1),
(2), (4) Date: Sep. 17, 2013

(87) PCT Pub. No.: WO2012/128259

PCT Pub. Date: Sep. 27, 2012

(65) Prior Publication Data

US 2014/0011152 A1 Jan. 9, 2014

(30) Foreign Application Priority Data

Mar. 23, 2011 (JP) ..... 2011-064320

(51) Int. Cl.
*C21B 9/00* (2006.01)
*C21B 9/14* (2006.01)
(Continued)

(52) U.S. Cl.
CPC ... *C21B 9/14* (2013.01); *C21B 9/10* (2013.01); *F23D 14/24* (2013.01); *F27B 17/0083* (2013.01); *F23D 2900/21001* (2013.01); *F27B 2017/0091* (2013.01)

(58) Field of Classification Search
CPC ..... C21B 9/00; C21B 9/04; C21B 9/06; F28D 17/00; F23D 14/62
USPC ..... 432/217, 214, 218, 247; 431/9, 161, 431/162, 166, 181, 187, 326, 328
See application file for complete search history.

(56) References Cited

U.S. PATENT DOCUMENTS 3,905,751 A 9/1975 Hemsath et al.
4,054,409 A * 10/1977 Ando et al. ..... 431/173
(Continued)

FOREIGN PATENT DOCUMENTS

CN 85100733 A 8/1986
CN 101381786 3/2009
(Continued)

OTHER PUBLICATIONS

International Search Report of PCT/JP2012/057051, mailed Jun. 19, 2012.
(Continued)

*Primary Examiner* — Gregory A Wilson
(74) *Attorney, Agent, or Firm* — McCarter & English

(57) ABSTRACT

There is provided a top-firing hot blast stove capable of enhancing combustion efficiency in burner system, supplying high-temperature combustion gas to an entire checker chamber, and suppressing damage on a refractory material on an inner wall of a burner duct.

A top-firing hot blast stove 10 has a burner system including: a burner 1 for passing fuel gas or combustion air to each of three or more pipe lines in a multiple pipe line structure; and a burner duct 2. A core pipe line 1*b* and a central pipe line 1*c* include a swirling flow generating means provided for generating a swirling flow of the fuel gas or the combustion air, while an outermost pipe line 1*d* carries a linear flow of the fuel gas or the combustion air, so that combustion gas HG including a linear component HG" and a swirling component HG' is generated in the burner duct 2. The combustion gas HG is supplied to a combustion chamber 3 from at least one or more of the burner systems in an inflow direction which does not pass through a center position of the combustion chamber 3.

20 Claims, 8 Drawing Sheets

(51) Int. Cl.

| | |
|---|---|
| ***C21B 9/10*** | (2006.01) |
| ***F23D 14/24*** | (2006.01) |
| ***F27B 17/00*** | (2006.01) |

(56) References Cited

U.S. PATENT DOCUMENTS

| | | | | |
|---|---|---|---|---|
| 4,657,504 | A | 4/1987 | Akiyama et al. | |
| 4,881,895 | A * | 11/1989 | Felthuis et al. | 432/181 |
| 5,052,922 | A * | 10/1991 | Stokman et al. | 432/181 |
| 5,433,599 | A * | 7/1995 | Van Laar et al. | 431/181 |
| 7,654,819 | B2 * | 2/2010 | Okada et al. | 431/8 |
| 7,775,791 | B2 | 8/2010 | Swanson et al. | |
| 2004/0166451 | A1 | 8/2004 | Watanabe | |
| 2007/0254251 | A1 | 11/2007 | Cao et al. | |
| 2010/0279239 | A1 | 11/2010 | Takashima et al. | |
| 2011/0076628 | A1 * | 3/2011 | Miura et al. | 431/12 |
| 2014/0004475 | A1 | 1/2014 | Maekawa et al. | |

FOREIGN PATENT DOCUMENTS

| | | | |
|---|---|---|---|
| EP | 0491079 | | 6/1992 |
| JP | 41-1272 | B1 | 2/1966 |
| JP | 41-4681 | B1 | 3/1966 |
| JP | 48-4284 | B | 2/1973 |
| JP | 50-123006 | A | 9/1975 |
| JP | 52-89502 | A | 7/1977 |
| JP | S6056152 | | 4/1985 |
| JP | 5-61604 | U | 8/1993 |
| JP | 09-021509 | | 1/1997 |
| JP | 2005060834 | A | 3/2005 |
| JP | 3793466 | B2 | 7/2006 |

OTHER PUBLICATIONS

Translation of First Office Action of Chinese Patent Application No. 201280012294.9, issued date of May 6, 2014.

Supplementary European Search Report dated Jul. 28, 2014 relating to European Patent Application No. EP12757821.

Translation of First Office Action of Chinese Patent Application No. 201280012288.3, issued date of Jun. 23, 2014.

* cited by examiner (a)

(b)

(a)

(b)

(a)

(b)

TOP-FIRING HOT BLAST STOVE

RELATED APPLICATIONS

This application is a national stage application filed pursuant to 35 U.S.C. §371 of PCT/JP2012/057051, filed Mar. 19, 2012, which claims the benefit of Japanese Patent Application No. 2011-064320, filed Mar. 23, 2011, which is incorporated herein by reference in its entirety.

TECHNICAL FIELD

The present invention relates to a top-firing hot blast stove having a characteristic burner system.

BACKGROUND ART

Regenerative hot blast stoves, which generate hot blast by circulating air to a checker chamber having heat stored therein and supply the hot blast to a blast furnace, include an internal-combustion hot blast stove having both a combustion chamber and a checker chamber provided inside a cylinder shell and an external-combustion hot blast stove having a combustion chamber and a checker chamber provided in separate cylinder shells so that both the chambers communicate with each other at one ends of both the shells. As a regenerative hot blast stove which can be made at a lower equipment cost than the external-combustion hot blast stove while retaining the performance comparable with the external-combustion hot blast stove, a top-firing hot blast stove having a combustion chamber, which is connected to a burner, provided above a checker chamber is disclosed in Patent Literature 1.

Now, referring to a schematic view of FIG. 7, the structure of a conventional top-firing hot blast stove will be outlined. As shown in the drawing, a conventional top-firing hot blast stove F has a combustion chamber N placed above a checker chamber T. In so-called combustion operation, mixed gas including fuel gas and combustion air supplied from a burner B to the combustion chamber N (X1 direction) ignites and combusts in the process of passing through a burner duct BD, and flows into the combustion chamber N as high-temperature combustion gas. As shown in FIG. 8 that is a cross sectional view taken along arrow line VIII-VIII of FIG. 7, a plurality of the burner ducts BD (four in FIG. 8) are provided for the combustion chamber N when two-dimensionally viewed. High-temperature combustion gas flows downward while swirling inside the combustion chamber with a large turning radius (X4 direction). While the combustion gas flows downward in the checker chamber T (X2 direction), the heat of the gas is stored in the checker chamber T, and the combustion gas which has passed through the checker chamber T is exhausted through a gas duct E. Note that the burner B and the burner duct BD are collectively referred to as a burner system in this specification.

A concrete mounting configuration of the burner ducts BD on the combustion chamber N is as shown in FIG. 8. That is, for example, four burner ducts BD are mounted on the combustion chamber N in a state displaced by 90 degrees as viewed two-dimensionally, and each of the burner ducts BD is connected to the combustion chamber N at an eccentric position so that an inflow direction of the combustion gas to the combustion chamber N does not pass through center O of the combustion chamber N which is in a circular shape when two-dimensionally viewed. As a result, the combustion gas which has flowed into the combustion chamber N from each one of the burner ducts BD interferes with the combustion gas which has flowed into the combustion chamber N from its adjacent burner duct BD. Thus, the flow direction of each combustion gas is changed so as to form a large swirling flow (X4-direction flow) of the combustion gas in the combustion chamber N.

As shown in FIG. 8, by forming a large swirling flow of combustion gas in the combustion chamber N, high-temperature combustion gas is supplied to the entire checker chamber T. This makes it possible to provide a hot blast stove which uses the entire checker chamber T to have high hot-blast generating capability.

In so-called air blasting operation for supplying hot blast to an unshown blast furnace, a shutoff valve V inside the burner duct BD is controlled to be closed so that supply of fuel gas and combustion air is stopped in the burner system, and air of about 150° C. for example is supplied to the checker chamber T through a blast pipe S. In the process of going upward inside the checker chamber T, the air turns into hot blast of about 1200° C. for example, and this hot blast is supplied to the blast furnace through a hot air pipe H (X3 direction).

Thus, in the combustion operation, low-temperature mixed gas, including low-temperature fuel gas and combustion air before combustion, circulates through the burner duct, so that the burner duct is cooled and put in a cold state. Contrary thereto, in air blasting operation, hot blast which passes through the checker chamber and goes upward is filled in the combustion chamber, so that the burner duct communicating with the combustion chamber is heated. More specifically, the burner duct is alternately subjected to cooling in combustion operation and heating in air blasting operation in a repeated manner, and thus repeated cooling and heating tends to damage, for example, a refractory material (ceramics such as bricks) which protects an inner wall of the burner duct, whereby the life thereof is disadvantageously limited.

Enhancement in combustion efficiency of the burner system is one of the important objects in the technical field concerned. In order to achieve the enhancement in combustion efficiency, it is important to prepare mixed gas including sufficiently mixed fuel gas and combustion air.

Examples of a conventional burner which constitutes the burner system include a concentric burner B having a triple tube structure as shown in FIGS. 9*a* and 9*b*. In the burner B, combustion air A1 is circulated through a core pipe line Ba, fuel gas G is circulated through a central pipe line Bb in an outer circumference of the core pipe line Ba, and additional combustion air A2 is circulated through an outermost pipe line Bc in a further outer circumference of the central pipe line Bb (X1 direction). Swirling blades Ra, Rb, and Rc fixed to the pipe lines Ba, Bb and Bc, respectively, generate swirling flows of the combustion air A1 and A2, and the fuel gas G in Y1, Y2 and Y3 directions, respectively, and these swirling flows are mixed in the burner duct BD to generate mixed gas MG. Note that Patent Literature 2 discloses a combustion burner structured to have a swirling blade provided in an outermost pipe line in a multiple pipe line structure.

While swirling and circulating in the inside of the burner duct BD, the mixed gas MG ignites and combusts. The gas after combustion flows into the combustion chamber N while swirling like the gas before combustion.

However, when a swirling flow of the mixed gas MG is generated and then combusted to produce a swirling flow of combustion gas inside the burner duct BD, and this swirling flow flows into the combustion chamber N as shown in FIG. 9*a*, a still larger swirling flow of the combustion gas (this swirling flow is not a two-dimensional swirling flow X4 shown in FIG. 8) is formed inside the combustion chamber N, and this swirling flow rapidly falls, for example, toward the checker chamber T below the combustion chamber N. It is hard, therefore, to form a combustion gas flow which flows from the burner duct BD into the combustion chamber N as a linear flow (X1 direction) as shown in FIG. 8.

A large swirling flow of the combustion gas (X4-direction flow) is formed inside the combustion chamber N as shown in FIG. 8 when combustion gas flows, which flow into the combustion chamber N from the respective burner ducts BD, have a linear component of certain degree so that the combustion gas interferes with each other to cause formation of the large swirling flow. Therefore, if a large swirling flow of mixed gas as shown in FIG. 9, and by extension a swirling flow of combustion gas resulting from combustion of the swirling flow, are simply formed in the burner duct BD in an attempt of achieving sufficient mixing of combustion air with fuel gas to form mixed gas, it is not possible to form, inside the combustion chamber N, a large swirling flow (X4-direction flow) capable of supplying high-temperature combustion gas to the entire region of the checker chamber T because the combustion gas does not have a sufficient linear component.

In view of these circumstances, it is desired to develop a technology capable of accomplishing all the challenges including: generating mixed gas including sufficiently mixed fuel gas and combustion air in the burner system; providing a sufficient linear component to combustion gas, which is obtained by combustion of mixed gas in the burner duct, introducing the combustion gas into the combustion chamber, and forming a large swirling flow inside the combustion chamber to supply high-temperature combustion gas to the entire checker chamber; and solving the problem of a refractory material on an inner wall of the burner duct being likely to be damaged by repeated cooling and heating applied to the refractory material on the inner wall of the burner duct.

CITATION LIST

Patent Literature

Patent Literature 1: JP Patent Publication (Kokoku) No. 48-4284 B (1973)

Patent Literature 2: JP Patent No. 3793466

SUMMARY OF INVENTION

Technical Problem

The present invention has been made in view of the foregoing problems, and an object of the present invention is to provide a top-firing hot blast stove capable of accomplishing all the challenges including: generating mixed gas including sufficiently mixed fuel gas and combustion air in the burner system; providing a sufficient linear component to combustion gas, which is obtained by combustion of mixed gas in the burner duct, introducing the combustion gas into the combustion chamber, and forming a large swirling flow inside the combustion chamber to supply high-temperature combustion gas to the entire checker chamber; and solving the problem of a refractory material on an inner wall of the burner duct being likely to be damaged by repeated cooling and heating applied to a region of the burner duct on the combustion chamber side.

Solution to Problem

In order to accomplish the above object, a top-firing hot blast stove according to the present invention includes: a checker chamber including a blast pipe for receiving supply of hot blast air; and a combustion chamber which includes a hot-blast pipe and a burner system for supplying hot blast to a blast furnace and which is placed above the checker chamber, wherein the checker chamber is heated by combustion of mixed gas including fuel gas and combustion air supplied from the burner system to the combustion chamber, and hot blast which is generated while the hot blast air passes through the checker chamber is supplied to the blast furnace through the hot-blast pipe, wherein the burner system includes: a burner of a multiple pipe line structure having three or more pipe lines different in diameter, each of the pipe lines carrying fuel gas or combustion air; and a burner duct communicating with the burner, the burner duct communicating with the combustion chamber, wherein among the pipe lines constituting the multiple pipe line structure, those other than an outermost pipe line include a swirling flow generating means provided for generating a swirling flow of the fuel gas or the combustion air which flows inside the pipe lines, whereas the outermost pipe line carries a linear flow of the fuel gas or the combustion air, wherein a swirling flow of mixed gas is generated by the swirling flows of the fuel gas and the combustion air which have flowed into the burner duct, and the swirling flow of the mixed gas and the linear flow of the fuel gas or the combustion air combust while flowing through the burner duct, so that combustion gas including a linear component and a swirling component is generated, and wherein the combustion gas is supplied to the combustion chamber from at least one or more of the burner systems in an inflow direction which does not pass through a center position of the combustion chamber.

In the top-firing hot blast stove of the present invention, modification is applied to the burner constituting the burner system which is a component member of the top-firing hot blast stove. That is, in the burner of a multiple pipe line structure having three or more pipe lines different in diameter, the pipe lines other than the outermost pipe line include a swirling flow generating means provided for generating a swirling flow of fuel gas or combustion air, and these swirling flows are mixed inside the burner duct so that sufficiently-mixed mixed gas can be generated. Further, the outermost pipe line of the burner carries the fuel gas or the combustion air as a linear flow without being swirled, and the linear flow is directly introduced into the burner duct, so that the swirling flow of the mixed gas and the linear flow of the fuel gas or the combustion air are circulated through the burner duct.

For example, assume the case where the burner has a concentric triple pipe line structure, with combustion air introduced to its core pipe line, fuel gas to its central pipe line, and additional combustion air to its outermost pipe line. In this case, swirling flows of both the fuel gas and the combustion air are generated by the swirling flow generating means provided in these two center pipe lines, and these swirling flows are mixed inside the burner duct. The resulting mixed gas flows through the burner duct together with the additional combustion air which flows straight in the periphery of the mixed gas without swirling. More specifically, a gas flow made of a mixture of a linear component from the combustion air and a swirling component from the mixed gas is formed in the burner duct, and the formed gas flow ignites and combusts in a region of the burner duct in the vicinity of the combustion chamber. The gas after combustion also turns into the combustion gas having a linear component and a swirling component like the gas flow before combustion, and flows into the combustion chamber.

The swirling component of the combustion gas generated by the swirling flow generating means in these two center pipe lines forms a negative pressure region in a central portion of the burner duct. High temperature atmosphere in the combustion chamber is taken in the thus-formed negative pressure region, and the taken-in high temperature atmosphere is radiated to an inner wall of the burner duct. This makes it possible to warm the inner wall which tends to be cooled in combustion operation.

Since the inner wall of a region of the burner duct on the combustion chamber side is warmed in combustion operation, temperature difference on the inner wall between in combustion operation and in air blasting operation is considerably decreased. Accordingly, it becomes possible to effectively suppress damage on the refractory material on the inner wall of the burner duct caused by repeated cooling and heating.

Moreover, since the combustion gas has a linear component, the combustion gas can be introduced into the combustion chamber with sufficient linearity imparted thereto. The combustion gas, which has flowed into the combustion chamber with the linear component, interferes with the combustion gas which has flowed into the combustion chamber from other burner systems, or the combustion gas with the linear component flows into the combustion chamber and then hits against an opposite inner wall of the combustion chamber so that a flow direction thereof is changed. As a consequence, a large swirling flow of the combustion gas is easily formed in the combustion chamber as viewed two-dimensionally, which makes it possible to supply high-temperature combustion gas to the entire region of the checker chamber.

Thus, in the top-firing hot blast stove of the present invention, modification is applied to the burner constituting the burner system which is a component member of the top-firing hot blast stove. Consequently, a swirling flow of mixed gas and a linear flow of fuel gas or combustion air are generated inside the burner duct, and these flows are combusted inside the burner duct, so that combustion gas with a linear component and a swirling component are generated. More specifically, by optimizing the flow components of the combustion gas, it becomes possible to generate, inside the burner system, mixed gas including sufficiently mixed fuel gas and combustion air, and to thereby enhance combustion efficiency in burner system. Moreover, a large swirling flow of combustion gas can be formed inside the combustion chamber and can be supplied to the entire checker chamber, which makes it possible to form the hot blast stove excellent in hot-blast generating capability. Furthermore, it becomes possible to decrease temperature difference on the inner wall of the burner duct between in combustion operation and in air blasting operation, and to thereby enhance durability of the refractory material on the inner wall of the burner duct.

Now, as the swirling flow generating means, following two embodiments may be provided.

One embodiment is to provide a swirling blade in each of the pipe lines other than the outermost pipe line.

For example, in the case where the burner has a concentric triple pipe line structure, two center pipe lines are each provided therein with a swirling blade peculiar to each pipe line. In the case where the burner has a concentric quintuple pipe line structure, four center pipe lines are each provided therein with a swirling blade peculiar to each pipe line. In any of the structures, the outermost pipe line is not provided with a swirling blade, so that fuel gas or combustion air flows through the outermost pipe line as a linear flow and flows into the burner duct.

The other embodiment of the swirling flow generating means is to provide a different generating means to each of the multiple pipe lines which constitute the burner. That is, a core pipe line having a minimum diameter is provided with a swirling blade, and in pipe lines other than the outermost pipe line and the core pipe line, fuel gas or combustion air is supplied at a position eccentric to or in a direction inclined to an axial center of the pipe lines.

The present embodiment is similar to the foregoing embodiment in the point that the core pipe line positioned in the center has a swirling blade. However, the swirling flow generating means applied to other pipe lines except the outermost pipe line is structured such that a direction of supplying fuel gas or combustion air to the pipe lines is adjusted so that the fuel gas or the combustion air is supplied at a position eccentric to or in a direction inclined to an axial center of the pipe lines. As a result, it becomes possible to form a swirling flow (or a spiral flow) in the periphery of the pipe line with a smaller diameter.

For example, in the case where the burner has a concentric triple pipe line structure, supply of gas to the pipe line positioned in the middle is performed at a position eccentric to an axial center of the pipe line, so that a swirling flow is formed in the periphery of the core pipe line and flows into the burner duct.

As a mounting configuration of the burner system on the combustion chamber, it is preferable that three of the burner systems are placed on the combustion chamber at intervals of 120 degrees and that the combustion gas is supplied from the respective burner systems to the combustion chamber in an inflow direction which does not pass through a center position of the combustion chamber. Further, it is desirable that four of the burner systems are placed on the combustion chamber at intervals of 90 degrees and that the combustion gas is supplied from the respective burner systems to the combustion chamber in an inflow direction which does not pass through a center position of the combustion chamber.

As for the mounting configuration of the burner system on the combustion chamber in the case where, for example, only one burner system is provided, the burner system may be so placed that combustion gas is supplied in an inflow direction which does not pass through the center position of the combustion chamber. This makes it possible to generate a swirling flow inside the combustion chamber. In this case, however, the combustion gas, which has flowed into the combustion chamber from one burner system, hits against an opposite inner wall of the combustion chamber and changes its course thereby. As a result, the combustion gas forms a swirling flow while flowing along the inner wall of the combustion chamber.

In contrast, in the case where three burner systems are placed on the combustion chamber at intervals of 120 degrees, and in the case where four burner systems are placed on the combustion chamber at intervals of 90 degrees, it becomes easy for the combustion gas, which has flowed into the combustion chamber from one burner system, to interfere with the combustion gas from other burner systems. This mutual interference allows smooth formation of a large swirling flow in the combustion chamber as viewed two-dimensionally.

Advantageous Effects of Invention

According to the top-firing hot blast stove of the present invention, as is clear from the above description, a swirling flow of mixed gas and a linear flow of fuel gas or combustion air are generated inside the burner duct, and these flows are combusted inside the burner duct, so that combustion gas with a linear component and a swirling component are generated. As a result, it becomes possible to form the mixed gas including sufficiently mixed fuel gas and combustion air inside the burner system, and to thereby enhance the combustion efficiency in burner system. Moreover, it becomes possible to introduce the combustion gas with sufficient linear component into the combustion chamber from the burner duct, so that a large swirling flow of combustion gas can be formed inside the combustion chamber and can be supplied to the entire checker chamber, which makes it possible to provide the top-firing hot blast stove excellent in hot-blast generating capability. Further, the swirling component of the combustion gas in the burner duct forms a negative pressure region, and high temperature atmosphere in the combustion chamber is taken in the negative pressure region so that radiant heat thereof is supplied to the inner wall of the burner duct. As a result, it becomes possible to decrease temperature difference on the inner wall of the burner duct between in combustion operation and in air blasting operation, and to cancel or reduce a repeated cycle of cooling and heating therein, so that the durability of the refractory material placed on the inner wall can be enhanced.

DESCRIPTION OF EMBODIMENT

Hereinafter, a description will be given of embodiments of a top-firing hot blast stove of the present invention with reference to the drawings.

Figure 1:
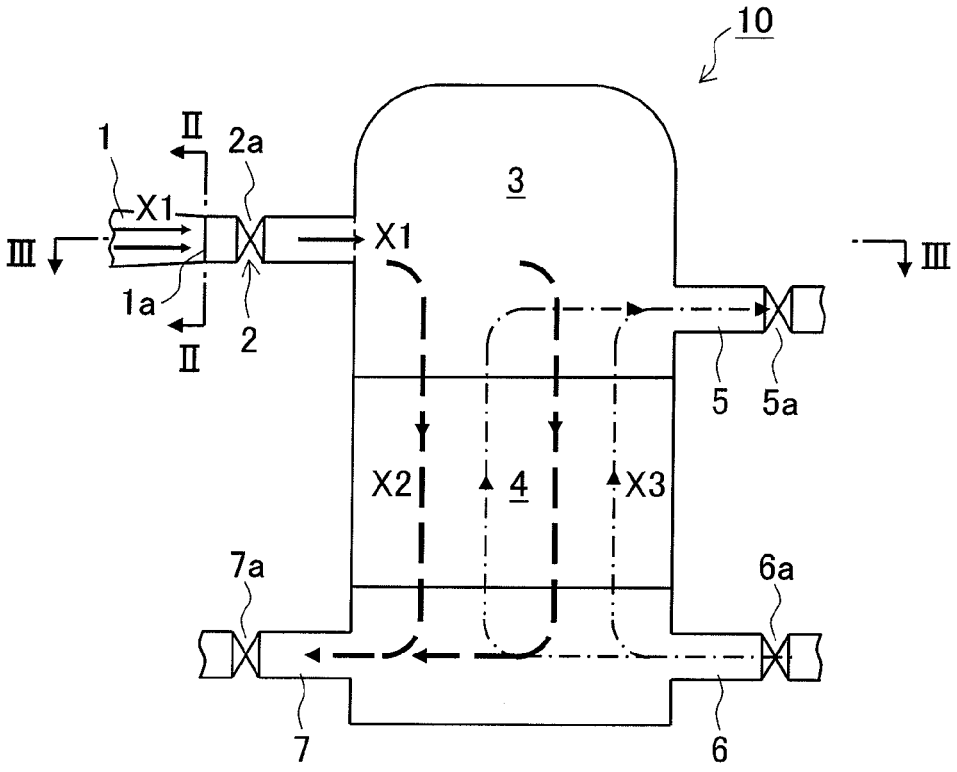
FIG. 1 is a schematic view showing one embodiment of a top-firing hot blast stove of the present invention, in which flows of mixed gas, combustion gas, hot blast air, and hot blast are illustrated together.
Figure 2:
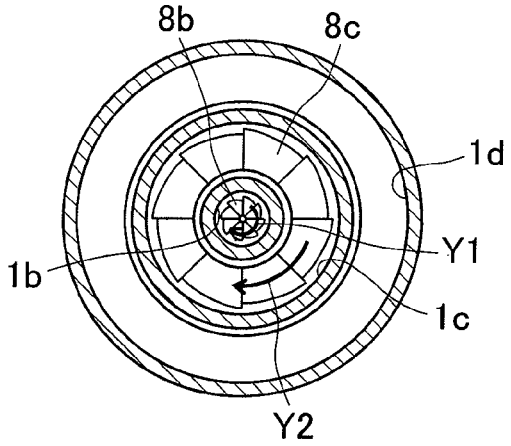
FIG. 2 is a cross sectional view taken along arrow line II-II of FIG. 1.

FIG. 1 is a schematic view showing one embodiment of a top-firing hot blast stove of the present invention, in which flows of mixed gas, combustion gas, hot blast air, and hot blast are illustrated together. FIG. 2 is a cross sectional view taken along arrow line II-II of FIG. 1. FIGS. 3*a*, 3*b*, 4*a* and 4*b* are cross sectional views taken along arrow line III-III of FIG. 1, each showing flows of combustion gas in a combustion chamber and showing a mounting configuration of burner systems on the combustion chamber. Further, FIG. 5 is a longitudinal sectional view of one embodiment of a burner system.

A top-firing hot blast stove 10 shown in FIG. 1 is structured in a circular form or generally circular form (such as oval forms) as a whole, and includes a combustion chamber 3 placed above a checker chamber 4. Mixed gas including fuel gas and combustion air supplied from a burner 1 (X1 direction) ignites and combusts in the process of passing through a burner duct 2, and flows into a combustion chamber 3 as high-temperature combustion gas. It is to be noted that the burner 1 and the burner duct 2 constitute a burner system. Strictly speaking, gas that flows from the burner duct 2 into the combustion chamber 3 includes not only combustion gas but also unburned mixed gas and fuel gas. In this specification, however, the combustion gas that is the main gas component flowing into the combustion chamber 3 is taken as an example for explanation.

As shown in FIG. 3*a*, four burner ducts 2 are provided on the combustion chamber 3 as viewed two-dimensionally, and the respective burner ducts are placed at positions displaced by 90 degrees from each other. Each of the burner ducts 2 is connected to the combustion chamber 3 at an eccentric position so that an inflow direction of the combustion gas to the combustion chamber 3 does not pass through center O of the combustion chamber 3 which is in a circular form when two-dimensionally viewed. As a result, the combustion gas which has flowed into the combustion chamber 3 from each one of the burner ducts 2 interferes with the combustion gas which has flowed into the combustion chamber 3 from its adjacent burner duct 2. Thus, the flow direction of each combustion gas is changed so as to form a large swirling flow of combustion gas (X4-direction flow) in the combustion chamber 3 as shown in the drawing.

Note that the mounting configuration of the burner duct 2 on the combustion chamber 3 is not limited to the aforementioned configuration, but may include a configuration of three burner systems placed on the combustion chamber 3 at intervals of 120 degrees as shown in FIG. 3*b*, a configuration of one burner system mounted on the combustion chamber 3 as shown in FIG. 4*a*, and a configuration of two burner systems mounted on the combustion chamber 3 at positions displaced by 90 degrees from each other as shown in FIG. 4*b*. In any of the configurations, the burner duct 2 is connected to the combustion chamber 3 at an eccentric position so that an inflow direction of the mixed gas to the combustion chamber 3 does not pass through the center O of the combustion chamber 3 which is in a circular form when two-dimensionally viewed.

Figure 3:
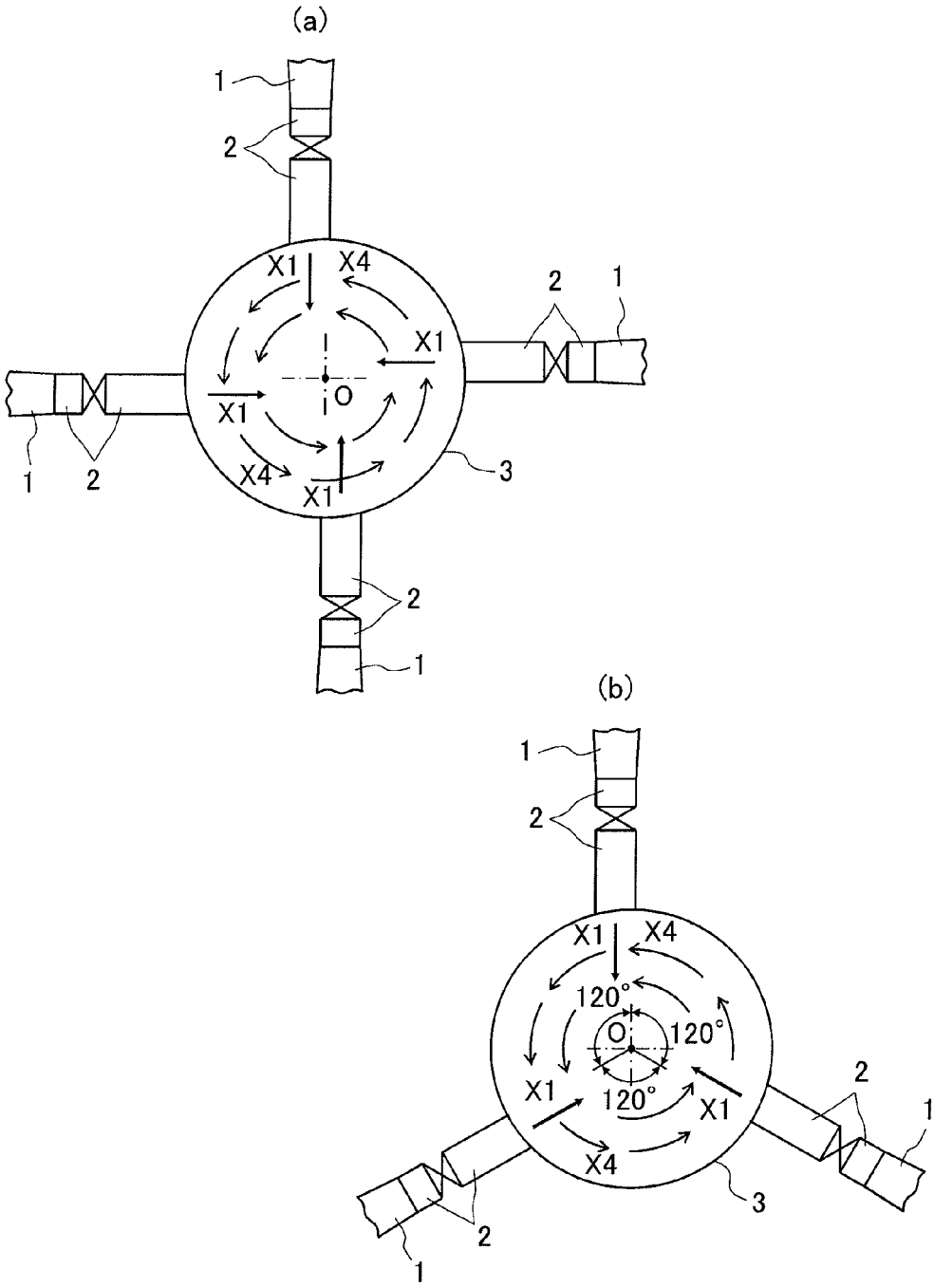
FIGS. 3(*a*) and (*b*) are cross sectional views taken along arrow line III-III of FIG. 1, each showing flows of combustion gas in a combustion chamber and showing a mounting configuration of burner systems on the combustion chamber.
Figure 4:
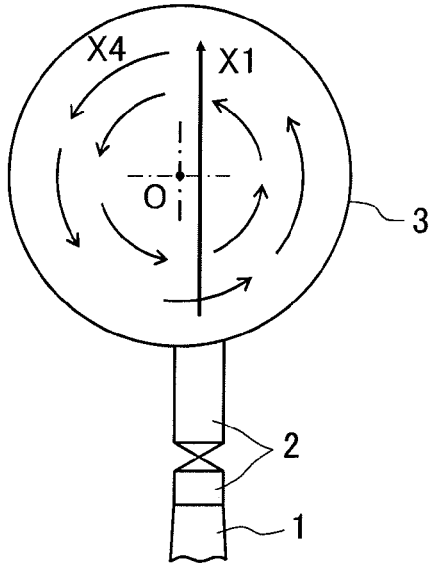
FIGS. 4(*a*) and (*b*) are cross sectional views taken along arrow line III-III of FIG. 1 like FIGS. 3*a* and *b*, each showing flows of combustion gas in a combustion chamber and showing a mounting configuration of burner systems on the combustion chamber.
Figure 4:
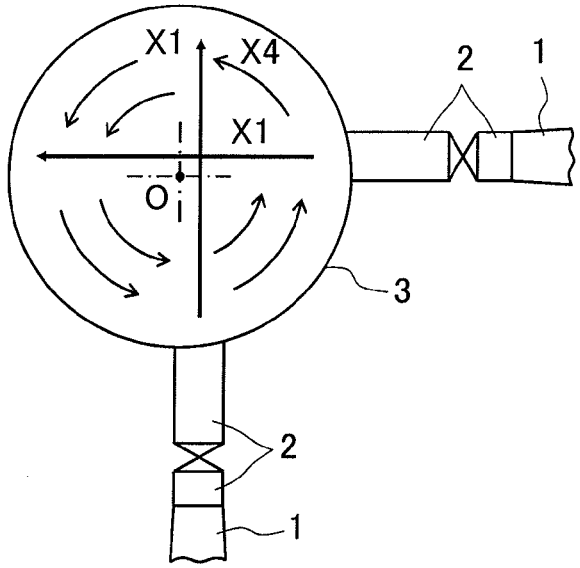
Figure 5:
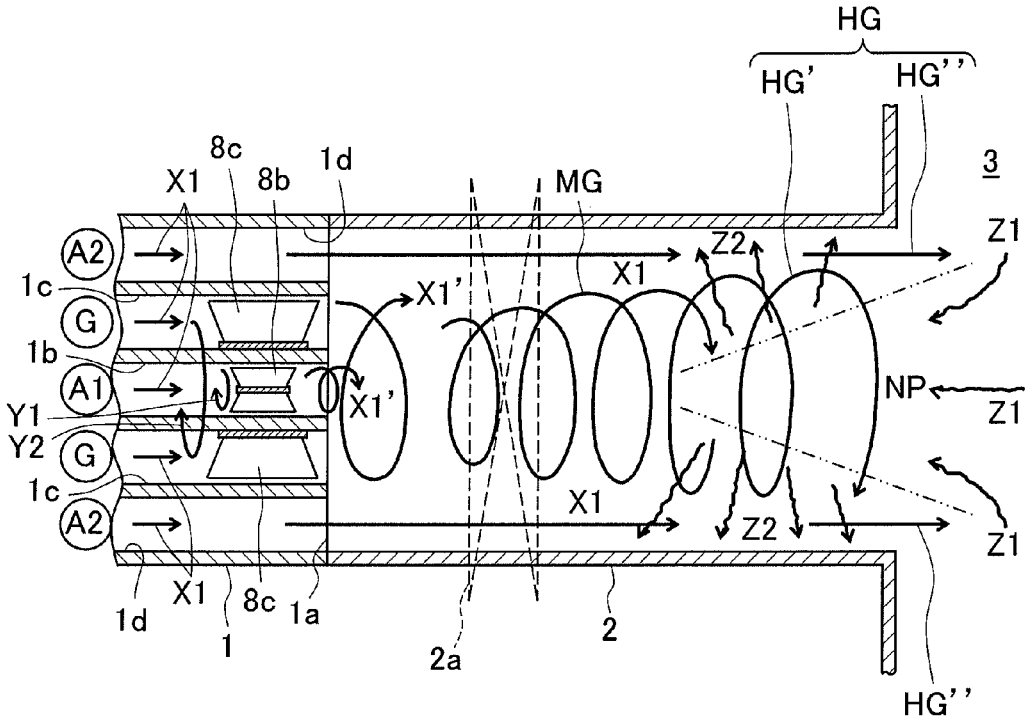
FIG. 5 is a longitudinal sectional view showing one embodiment of a burner system, in which combustion gas including a linear component and a swirling component as well as a negative pressure region formed by the combustion gas are explained.

The combustion gas flows downward to the entire checker chamber 4 while swirling with a large turning radius as viewed two-dimensionally as shown in FIGS. 3 and 4 and forming a spiral flow descending in X2 direction of FIG. 1 as viewed in longitudinal cross section. In the process of flowing downward, heat is stored in the checker chamber 4, and the combustion gas which has passed through the checker chamber 4 is exhausted through a gas duct pipe 7 in which a shutoff valve 7*a* is controlled to be opened. Such operation as combusting mixed gas in the burner system and heating the checker chamber 4 with high-temperature combustion gas supplied to the checker chamber 4 may be referred to as "combustion operation."

As shown in FIG. 2, the burner 1 has a concentric, three hole-type multiple pipe line structure. As shown in FIG. 5, the burner 1 is linked to the burner duct 2 at an end face 1*a* thereof in a communicating posture, so that a core pipe line 1*b* has combustion air A1 flowing therein, a central pipe line 1*c* has fuel gas G flowing therein, and an outermost pipe line 1*d* has additional combustion air A2 flowing therein.

Further, the core pipe line 1*b* and the central pipe line 1*c* other than the outermost pipe line 1*d* are provided with swirling blades 8*b* and 8*c*, respectively, fixed to insides thereof.

In two center pipe lines 1*b* and 1*c*, swirling flows X1' of the combustion air A1 and the fuel gas G (Y1 direction and Y2 direction) are each generated by the swirling blades 8*b* and 8*c*, and these swirling flows X1' are mixed inside the burner duct 2 and thereby a swirling flow of mixed gas MG is generated. The resulting mixed gas MG flows inside the burner duct 2 together with the additional combustion air A2, which flows straight in the periphery of the mixed gas without swirling.

More specifically, a gas flow made of a mixture of a linear component from the combustion air A2 and a swirling component from the mixed gas MG is generated in the burner duct 2, and this gas flow ignites and combusts in a region of the burner duct 2 in the vicinity of the combustion chamber. As a result, combustion gas HG having a linear component HG" and a swirling component HG' is generated like the gas flow before combustion, and this combustion gas HG flows into the combustion chamber 3.

The swirling component HG' in the combustion gas HG forms a negative pressure region NP in a region of the burner duct 2 on the combustion chamber 3 side. High temperature atmosphere in the combustion chamber 3 is taken in the thus-formed negative pressure region NP (Z1 direction), and the taken-in high temperature atmosphere is radiated to an inner wall of the burner duct 2 (Z2 direction). This makes it possible to warm the inner wall in the region of the burner duct 2 on the combustion chamber side, which tends to be cooled in combustion operation.

Since the inner wall of the burner duct 2 is warmed in combustion operation, temperature difference on the inner wall between in combustion operation and in air blasting operation is considerably decreased. Accordingly, it becomes possible to effectively suppress damage on the refractory material on the inner wall of the burner duct caused by repeated cooling and heating.

Moreover, since the combustion gas HG has the linear component HG", the combustion gas HG can be introduced into the combustion chamber 3 with sufficient linearity imparted thereto. The combustion gas HG, which has flowed into the combustion chamber 3 with the linear component, interferes with the combustion gas which has flowed into the combustion chamber 3 from other burner systems (in the case of FIGS. 3*a* and 3*b*), or the combustion gas HG flows into the combustion chamber 3 and then hits against an opposite inner wall of the combustion chamber 3 so that a flow direction thereof is changed (in the case of FIGS. 4*a* and 4*b*). As a consequence, a large swirling flow X4 of the combustion gas HG as viewed two-dimensionally is easily formed in the combustion chamber 3, which makes it possible to supply high-temperature combustion gas HG to the entire region of the checker chamber 4.

Figure 6:
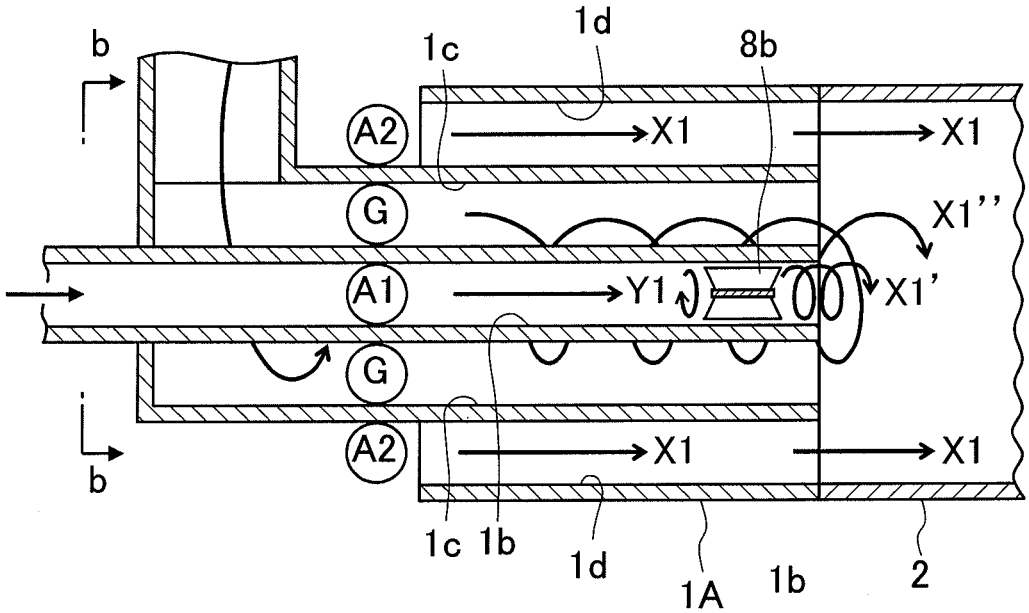
FIG. 6(*a*) is a longitudinal sectional view of another embodiment of a burner which constitutes a burner system, while FIG. 6(*b*) is a cross sectional view taken along arrow line b-b of FIG. 6(*a*).
Figure 6:
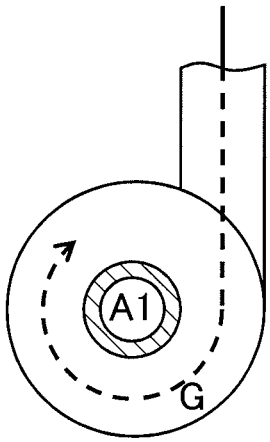
Figure 7:
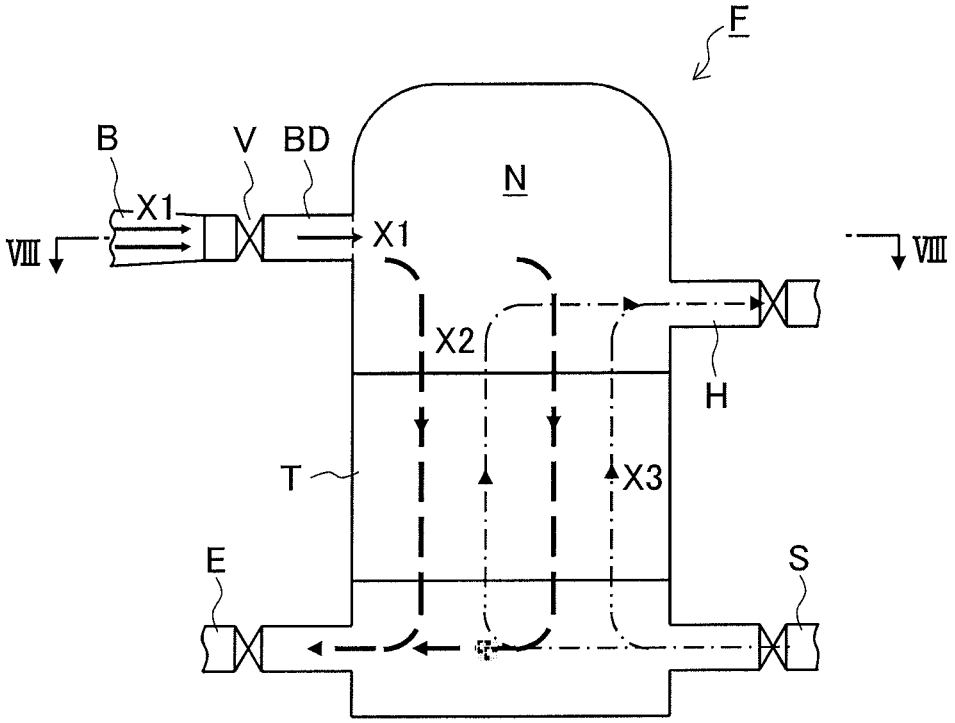
Fig. 7 (Prior Art)
FIG. 7 is a schematic view showing one embodiment of a conventional top-firing hot blast stove, in which flows of mixed gas, combustion gas, hot blast air, and hot blast are illustrated together.
Figure 8:
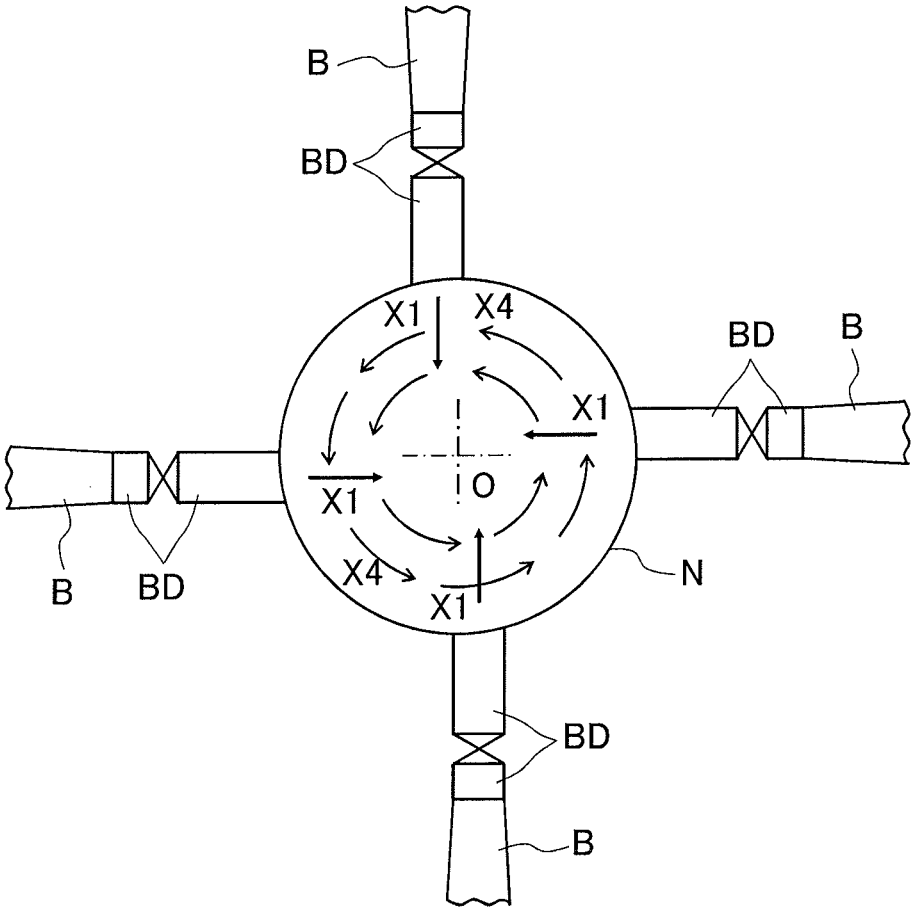
Fig. 8 (Prior Art)
FIG. 8 is a cross sectional view taken along arrow line VIII-VIII of FIG. 7, showing flows of combustion gas in the combustion chamber.
Figure 9:
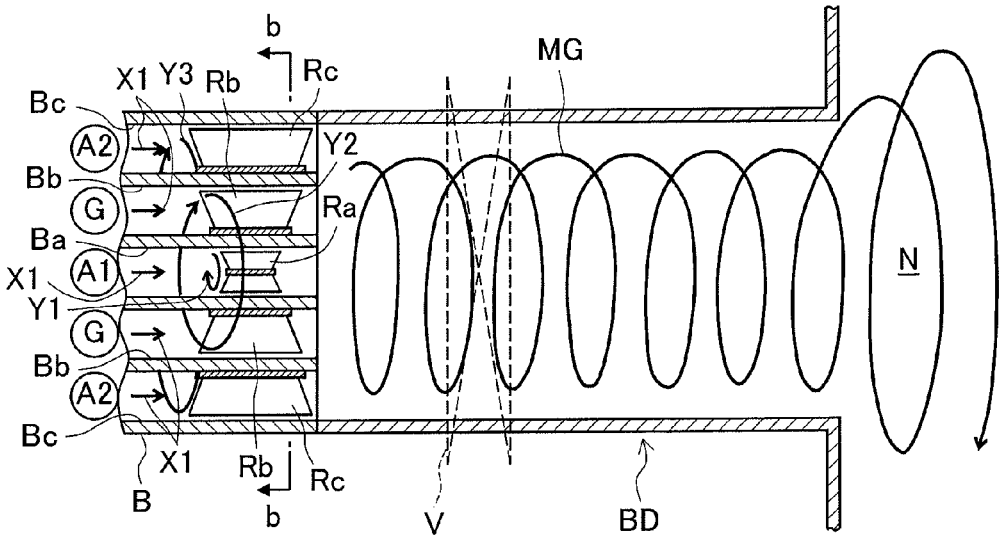
Fig. 9 (Prior Art)
FIG. 9 is a longitudinal sectional view showing one embodiment of a conventional burner system.
Figure 9:
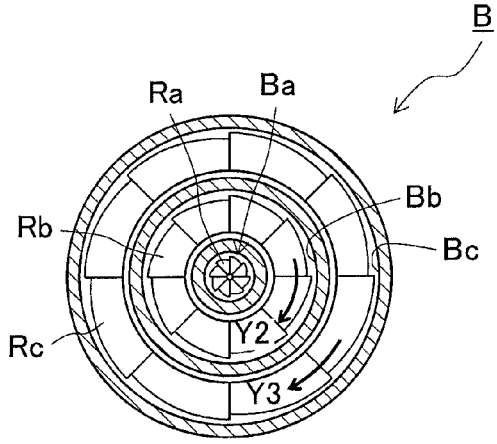
Fig. 9 (Prior Art)

FIG. 6*a* shows another embodiment of the burner which constitutes the burner system. This burner 1A also has a concentric triple pipe line structure. However, the core pipe line 1*b* is provided with the swirling blade 8*b*, and in the central pipe line 1*c*, a supply direction of fuel gas G into the pipe line is eccentric to an axial center of the pipe line, so that the gas is supplied at this eccentric position as shown in FIG. 6*b*. Since the fuel gas G is supplied into the central pipe line 1*c* at the eccentric position or in an inclined direction, a swirling flow X1" (or a spiral flow) can be formed in the periphery of the core pipe line 1*b* inside the central pipe line 1*c*.

Referring again to FIG. 1, when hot blast is supplied to an unshown blast furnace, a shutoff valve 2*a* in the burner duct 2 and a gas duct valve 7*a* in the gas duct pipe 7 are controlled to be closed, and through a blast pipe 6 with a shutoff valve 6*a* controlled to be opened, high temperature air of about 150° C. for example is supplied to the checker chamber 4. In the process of going upward in the checker chamber 4, the high temperature air turns into hot blast of about 1200° C. for example, and the hot blast is supplied to the blast furnace (X3 direction) through a hot-blast pipe 5 with a shutoff valve 5*a* controlled to be opened. Such operation as generating hot blast in the hot blast stove and supplying it to the blast furnace may be referred to as "air blasting operation."

According to the top-firing hot blast stove 10 shown in the drawing, a swirling flow of mixed gas MG and a linear flow of fuel gas or combustion air are generated inside the burner duct 2, and these flows are combusted inside the burner duct 2, so that combustion gas HG with a linear component HG" and a swirling component HG' are generated. As a result, it becomes possible to form the mixed gas MG including sufficiently mixed fuel gas and combustion air inside the burner system, and to thereby enhance the combustion efficiency in burner system. Moreover, it becomes possible to introduce the combustion gas HG with sufficient linear component into the combustion chamber 3 from the burner duct 2, so that a large swirling flow of the combustion gas HG can be formed inside the combustion chamber 3 and can be supplied to the entire checker chamber 4, which makes it possible to provide the top-firing hot blast stove excellent in hot-blast generating capability. Further, the swirling component HG' of the combustion gas HG in the burner duct 2 forms the negative pressure region NP, and high temperature atmosphere in the combustion chamber 3 is taken in the negative pressure region so that radiant heat thereof is supplied to the inner wall of the burner duct. As a result, it becomes possible to decrease temperature difference on the inner wall of the burner duct between in combustion operation and in air blasting operation, and to cancel or reduce a repeated cycle of cooling and heating therein, so that the durability of the refractory material placed on the inner wall can be enhanced.

Although each embodiment of the present invention has been described in full detail with reference to drawings, it should be understood that concrete structure is not limited to the embodiments described, and various modifications and variations in design which come within the scope and the spirit of the present invention are therefore intended to be embraced therein.

Reference Signs List

1, 1A . . . burner, 1*b* . . . core pipe line, 1*c* . . . central pipe line, 1*d* . . . outermost pipe line, 1*a* . . . burner exit, 2 . . . burner duct, 2*a* . . . shutoff valve, 3 . . . combustion chamber, 4 . . . checker chamber, 5 . . . hot-blast pipe, 6 . . . blast pipe, 7 . . . gas duct pipe, 8*b*, 8*c* . . . swirling blade, 10 . . . top-firing hot blast stove, G . . . fuel gas, A1, A2 . . . combustion air, MG . . . mixed gas, HG . . . combustion gas, HG' . . . swirling component of combustion gas, HG" . . . linear component of combustion gas

The invention claimed is:

1. A top-firing hot blast stove, comprising:

a checker chamber including a blast pipe for receiving supply of hot blast air; and a combustion chamber including a hot-blast pipe and a burner system for supplying hot blast to a blast furnace, the combustion chamber being positioned above the checker chamber, wherein the checker chamber is heated by combustion of mixed gas including fuel gas and combustion air supplied from the burner system to the combustion chamber, and hot blast which is generated while the hot blast air passing through the checker chamber is supplied to the blast furnace through the hot-blast pipe, wherein the burner system includes (i) a burner including a multiple pipe line structure, the multiple pipe line structure including three or more concentrically positioned pipe lines, and (ii) a burner duct communicating with an end face of the burner, the burner duct communicating with the combustion chamber through a burner duct outlet disposed at an opposing end of the burner duct relative to the end face, wherein the three or more concentrically positioned pipe lines carry fuel gas or combustion air, wherein pipe lines of the multiple pipe line structure other than an outermost pipe line include swirling flow generating means therein for generating a swirling flow of the fuel gas or the combustion air flowing inside the pipe lines, wherein the outermost pipe line carries a linear flow of the fuel gas or the combustion air, and wherein a swirling flow of mixed gas is generated by the swirling flow of the fuel gas and the combustion air which have flowed into the burner duct, the swirling flow of mixed gas being surrounded at a periphery by the linear flow of the fuel gas or the combustion air passing from the outermost pipe line.

2. The top-firing hot blast stove according to claim 1, wherein the swirling flow generating means comprises a swirling blade provided in each of the pipe lines other than the outermost pipe line.

3. The top-firing hot blast stove according to claim 1, wherein the three or more concentrically positioned pipe lines are different in diameter.

4. The top-firing hot blast stove according to claim 1, wherein after combustion of the swirling flow of mixed gas and the linear flow of the fuel gas or the combustion air, a linear component of combustion gas and a swirling component of combustion gas is generated.

5. The top-firing hot blast stove according to claim 4, wherein the linear component of combustion gas and the swirling component of combustion gas are supplied to the combustion chamber from the burner system in an eccentric inflow direction.

6. The top-firing blast stove according to claim 5, wherein the eccentric inflow direction is defined by flow of combustion gas from the burner duct into the combustion chamber which does not pass through a center of the combustion chamber.

7. The top-firing hot blast stove according to claim 6, wherein combustion gas from the burner duct flowing into the combustion chamber in the eccentric inflow direction forms a large swirling flow of the combustion gas in the combustion chamber.

8. The top-firing hot blast stove according to claim 5, wherein the linear component of combustion gas promotes formation of a large swirling flow of combustion gas in the combustion chamber.

9. The top-firing hot blast stove according to claim 1, wherein the swirling flow generating means is different for each pipe line.

10. The top-firing hot blast stove according to claim 1, wherein the swirling flow generating means for a core pipe line of the three or more concentrically positioned pipe lines comprises a swirling blade.

11. The top-firing hot blast stove according to claim 1, wherein at least one of the swirling flow generating means comprises supplying the fuel gas or the combustion air into a pipe line of the three or more concentrically positioned pipe lines at a position eccentric to or in a direction inclined to an axial center of the pipe line.

12. The top-firing hot blast stove according to claim 11, wherein supplying the fuel or the combustion air into the pipe line at the position eccentric to or in the direction inclined to the axial center of the pipe line forms a spiral flow of the fuel gas or the combustion air in a periphery of the pipe line prior to passage of the fuel gas or the combustion air from the pipe line into the burner duct at the end face of the burner.

13. The top-firing hot blast stove according to claim 1, wherein the three or more concentrically positioned pipe lines include a fuel gas pipe concentrically positioned around a combustion air pipe.

14. The top-firing hot blast stove according to claim 13, comprising a second combustion air pipe concentrically positioned around the fuel gas pipe.

15. The top-firing hot blast stove according to claim 1, comprising a second burner system and a third burner system, wherein the burner system, the second burner system and the third burner system are placed relative to the combustion chamber at intervals of 120 degrees and combustion gas is supplied from the respective burner systems to the combustion chamber in an eccentric inflow direction.

16. The top-firing hot blast stove according to claim 1, comprising a second burner system, a third burner system and a fourth burner system, wherein the burner system, the second burner system, the third burner system and the fourth burner system are placed relative to the combustion chamber at intervals of 90 degrees and combustion gas is supplied from the respective burner systems to the combustion chamber in an eccentric inflow direction.

17. A top-firing hot blast stove, comprising:

a checker chamber including a blast pipe for receiving supply of hot blast air; and a combustion chamber including a hot-blast pipe and a burner system for supplying hot blast to a blast furnace, the combustion chamber being positioned above the checker chamber, wherein the checker chamber is heated by combustion of mixed gas including fuel gas and combustion air supplied from the burner system to the combustion chamber, and hot blast which is generated while the hot blast air passing through the checker chamber is supplied to the blast furnace through the hot-blast pipe, wherein the burner system includes (i) a burner including a multiple pipe line structure, the multiple pipe line structure including pipe lines carrying fuel gas or combustion air, and (ii) a burner duct communicating with an end face of the burner, the burner duct communicating with the combustion chamber through a burner duct outlet disposed at an opposing end of the burner duct relative to the end face, wherein the pipe lines of the multiple pipe line structure other than an outermost pipe line include swirling flow generating means therein for generating a swirling flow of the fuel gas or the combustion air flowing inside the pipe lines, wherein at least one of the swirling flow generating means comprises supplying the fuel gas or the combustion air into at least one of the pipe lines at a position eccentric to or in a direction inclined to an axial center of the at least one pipe line, thereby forming a spiral flow of the fuel gas or the combustion air in a periphery of the at least one pipe line prior to passage of the fuel gas or the combustion air from the at least one pipe line into the burner duct at the end face of the burner.

18. The top-firing hot blast stove of claim 17, wherein the multiple pipe line structure comprises three or more concentrically positioned pipe lines.

19. The top-firing hot blast stove of claim 17, wherein the outermost pipe line carries a linear flow of the fuel gas or the combustion air.

20. The top-firing hot blast stove of claim 17, wherein the pipe lines extend up to the end face of the burner such that passage of the fuel gas or the combustion air from the pipe lines at the end face of the burner and into the burner duct generates a swirling flow of mixed gas from the swirling flows of the fuel gas and the combustion air surrounded at a periphery by linear flow of the fuel gas or the combustion air passing from the outermost pipe line.

* * * * *